US006622598B2

(12) United States Patent
Chang

(10) Patent No.: US 6,622,598 B2
(45) Date of Patent: Sep. 23, 2003

(54) ADJUSTABLE SLEEVE BARREL STRUCTURE

(76) Inventor: Chung-Shu Chang, 16-12, Chang Sheng Lane Res Meei Beei Ewen Area, Taichung (TW)

( * ) Notice: Subject to any disclaimer, the term of this patent is extended or adjusted under 35 U.S.C. 154(b) by 0 days.

(21) Appl. No.: 10/055,934

(22) Filed: Jan. 28, 2002

(65) Prior Publication Data

US 2003/0140741 A1 Jul. 31, 2003

(51) Int. Cl.[7] ..... B25B 13/18
(52) U.S. Cl. ..... 81/128; 81/129; 81/125
(58) Field of Search ..... 81/128, 129, 13, 81/125; 279/66, 110, 114, 123, 71

(56) References Cited

U.S. PATENT DOCUMENTS 2,403,264 A * 7/1946 Cormier ..... 81/6
2,850,931 A * 9/1958 Conway ..... 81/128
2,884,826 A * 5/1959 Bruhn ..... 81/128
3,209,624 A * 10/1965 Shiffman ..... 81/6
4,366,732 A * 1/1983 Schliep ..... 81/128
4,911,040 A * 3/1990 Kim ..... 81/128
5,660,088 A * 8/1997 Benson ..... 81/128
5,819,607 A * 10/1998 Carnesi ..... 81/128
5,996,446 A * 12/1999 Lee ..... 81/128
6,073,522 A * 6/2000 Carnesi ..... 81/128
6,341,544 B1 * 1/2002 Falzone ..... 81/128

* cited by examiner

*Primary Examiner*—Joseph J. Hail, III
*Assistant Examiner*—David B. Thomas
(74) *Attorney, Agent, or Firm*—Charles E. Baxley

(57) ABSTRACT

The present invention is an adjustable sleeve barrel structure comprising of a sleeve head, a sleeve body, and a set of pawls. The sleeve head is coupled on the bottom with the sleeve body, and both of them can rotate freely. The sleeve body has multiple slide rails distributed on its inner wall evenly The pawls slide in these slide rails, and the shafts on the top of these pawls extrude to the space designed between the sleeve head and the sleeve body. Connected to the shafts are corresponding connecting rods, which have corresponding pins fixed onto the sleeve head. When the sleeve head rotates, it drives the pawls through the connecting rods to open/close simultaneously. In this way, when the operator turn the sleeve barrel clockwise/anti-clockwise, the pawls will screw a nut down/up together, which is convenient and practical.

5 Claims, 6 Drawing Sheets

B-B

ADJUSTABLE SLEEVE BARREL STRUCTURE

FIELD OF THE INVENTION

This invention is an adjustable sleeve barrel structure with the purpose to lock/loose nuts of any size (in metric or English)/shape (male-tetragonal, male-hexagonal, female-tetragonal, or female-hexagonal) with the pawls opening/closing simultaneously at the bottom of the sleeve along with the rotation of the sleeve head

BACKGROUND OF THE INVENTION

Traditionally, multiple sleeve barrels of different sizes/shapes should be used to lock/loose nuts of different sizes/shapes. A complete set of these sleeve barrels will result in severe problems related with space, portability, convenience, and cost. Furthermore, if a sleeve barrel varies a bit in size/shape, further use of it will be a hard time.

In consideration of the shortcomings of legacy sleeve barrels, the inventor designed an adjustable sleeve barrel structure.

The main purpose of this invention is to provide an adjustable sleeve barrel structure to expand the application range of sleeve barrels.

The structure and purpose of this invention is detailed and illustrated as follows:

INSTRUCTION OF LEGENDS

10 Sleeve Head
11 Sleeve Eye
12 Bearing
13 Shoulder
14 Plug Jack
20 Sleeve Body
21 Blind Hole 1
22 Blind Hole 2
23 Groove
24 Notch
25 Slide Rail
251 Gap Groove
30 Ouch

Figure 1:
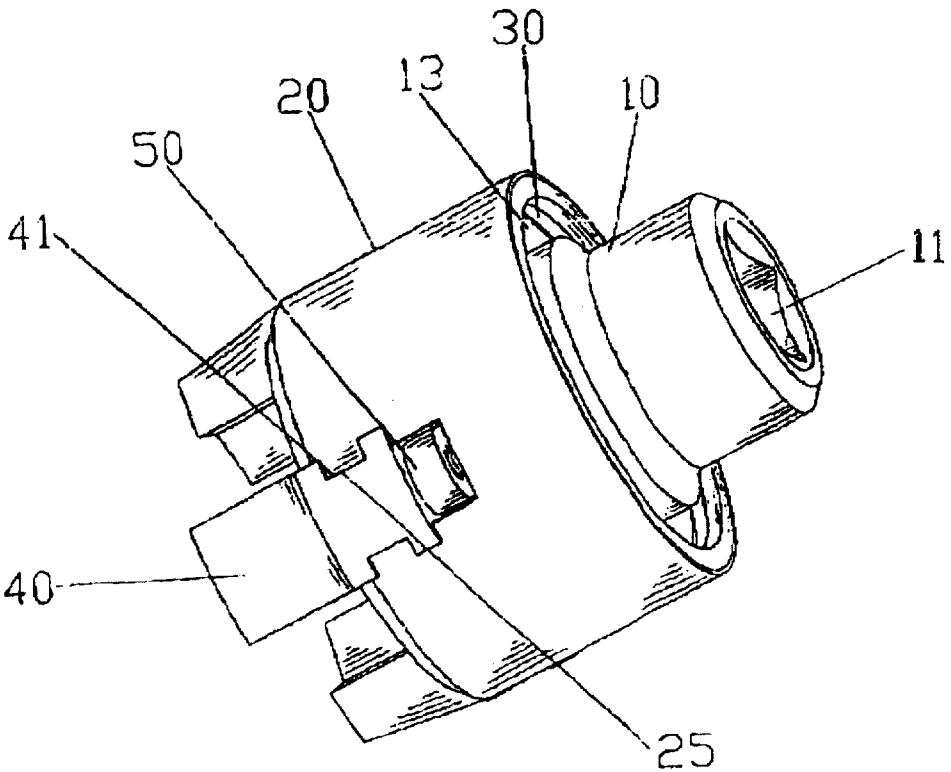
FIG. 1 is the 3D view of this invention.
Figure 2:
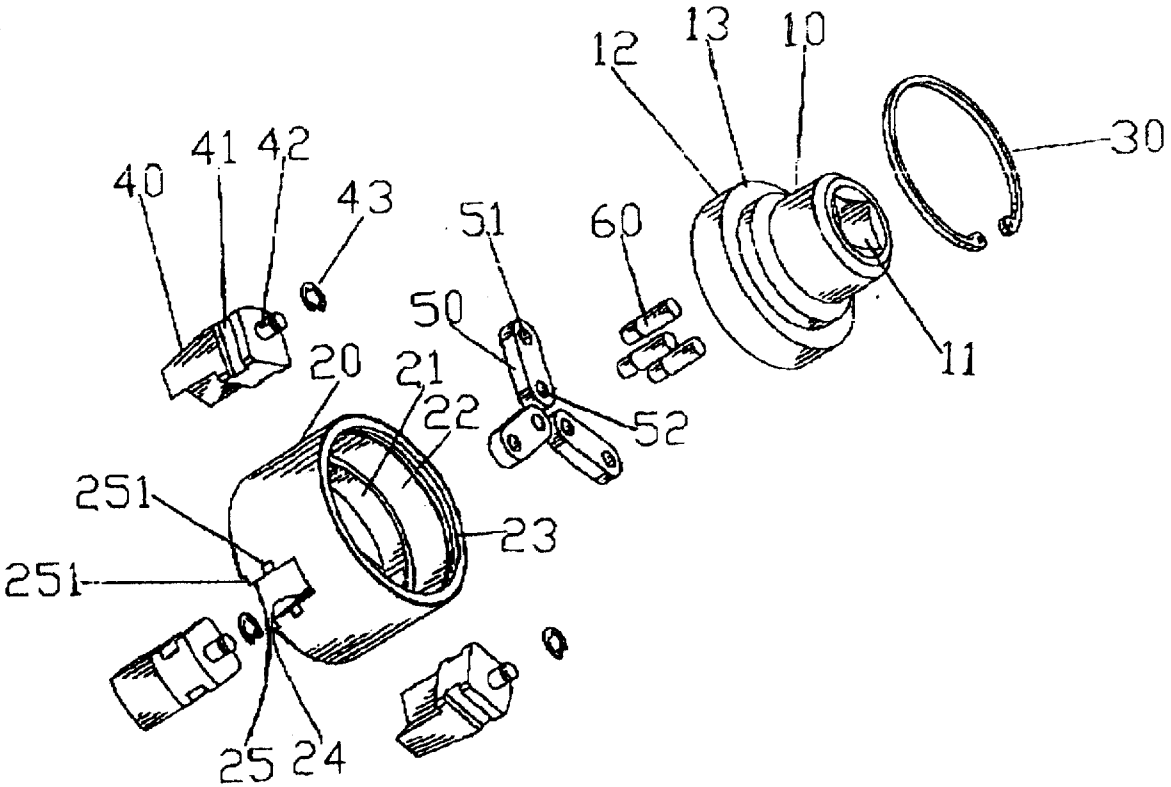
FIG. 2 is the exploded view of this invention.

40 Pawl
41 Guided Groove
42 Shaft
43 Ouch
50 Connecting Rod
51 Eye 1
52 Eye 2
60 Pin Please see FIG. 1 and FIG. 2. The sleeve barrel of this invention comprises a sleeve head (10), a sleeve body (20), and a pawl (40), the sleeve head (10) has a sleeve eye (11) on one end, through which a wrench or ratchet wrench can be plugged to rotate the sleeve head 10. On the other end of the sleeve head 10 there is a bearing (12) provided thereon, to form a shoulder (13) in the sleeve head 10.

Figure 3:
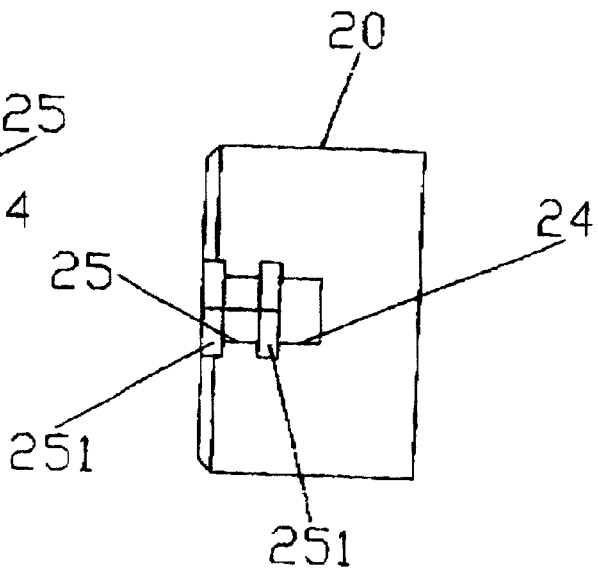
FIG. 3 is a sectional view of this invention.
Figure 4:
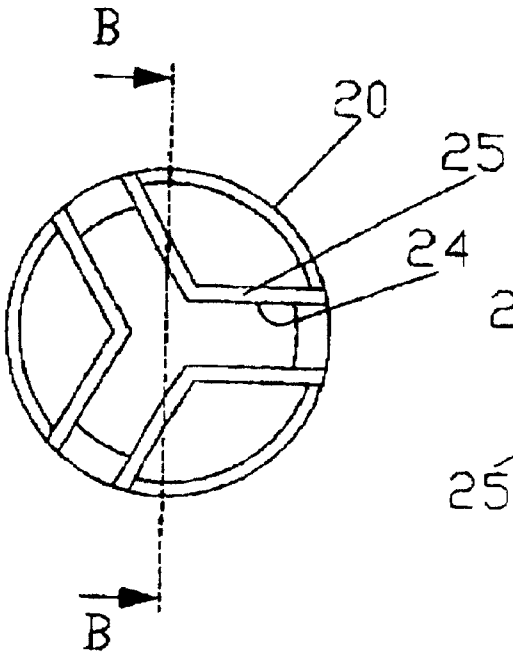
FIG. 4 is the upward view of this invention.
Figure 5:
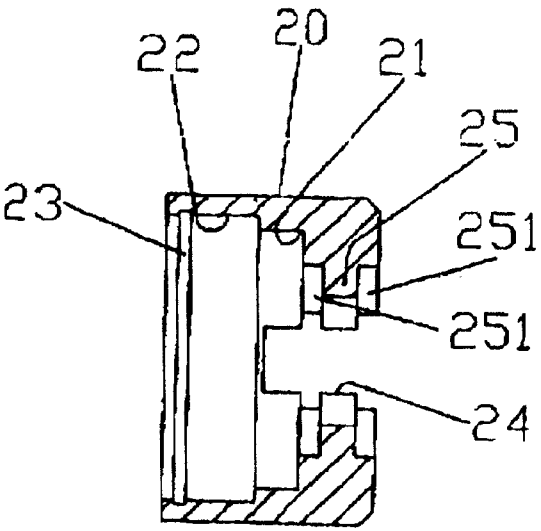
FIG. 5 is a sectional view of the sleeve head of this invention.

Please see FIG. 3, FIG. 4, and FIG. 5. The sleeve body (20) is a cylinder structure with blind hole 1 (21) on one end. On blind hole 1 (21) there is a deeper and larger hole—blind hole 2 (22), through which the bearing (12) can be plugged and positioned at the shoulder (210) between the blind hole 1 (21) and the blind hole 2 (22) of the sleeve body (20). On blind hole 2 (22) there is a groove (23) formed therein to receive a snap ring (30) therein which may engage with the shoulder (13) of the sleeve head (10) to position the bearing (12) of the sleeve head 10 in the sleeve body 20 and to allow the sleeve head (10) and the sleeve body (20) to rotate freely.

At the bottom of the sleeve body 20 there is a notch (24) running through the blind hole 1 (21) of the sleeve body (20), and it has a slide rail (25) and a gap groove (251) on the bottom of the slide rail 25. Each of three pawls (40) has a ramped clamping surface in its inner sidewall and a guided groove (41) on the top, which can be coupled with the slide rail 25 to make the three pawls (40) extrude out of the sleeve body 20 and slide freely. On the top of each pawl (40) there is a shaft (42) located at the position of the blind hole 1 (21) of the sleeve body (20) and enters into the corresponding eye of a connecting rod (50) to clamp the connecting rod (50) with the E-shape snap ring (43). In this way, each of the three connecting rods (50) can rotate freely on its corresponding shaft (42).

Figure 6:
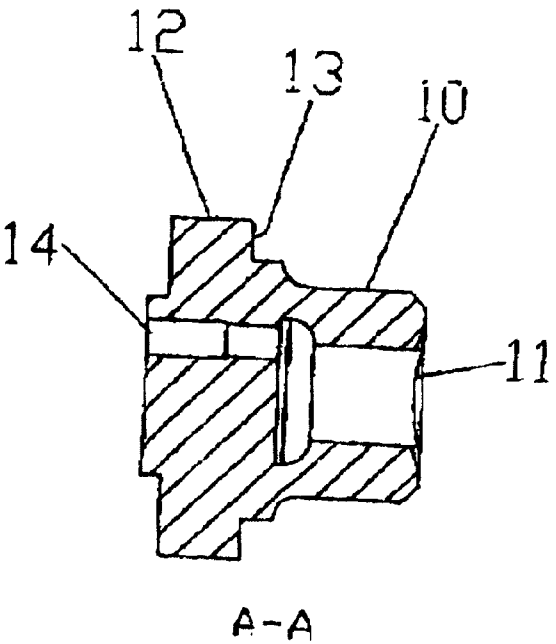
FIG. 6 is the upward view of the sleeve head.
Figure 7:
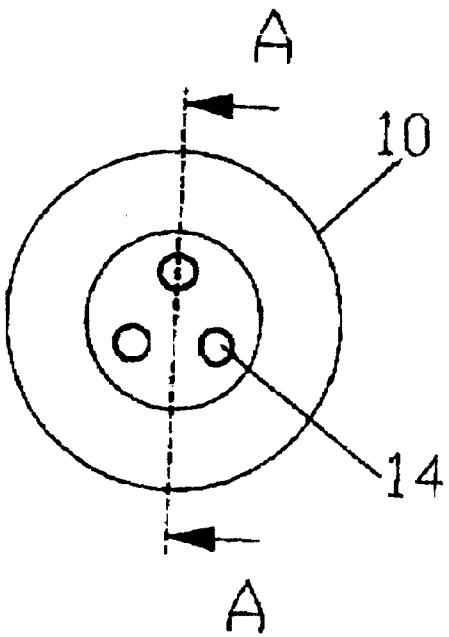
FIG. 7 is a sectional view of the sleeve head

On each connecting rod (50) there is an eye 2 (52), through which the pin (60) can be plugged, as shown in FIG. 6 and FIG. 7. There are three plug jacks (14) distributed evenly at the center of the bearing (12) and can be used to position the bearing (12) with the pin (60).

Figure 8:
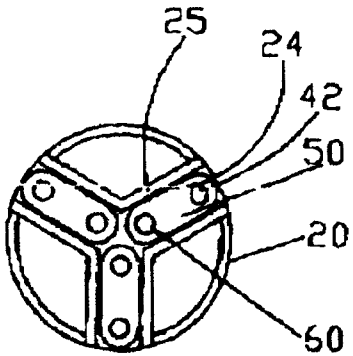
FIG. 8 is a sketch map of the connecting rod in its original position.
Figure 10:
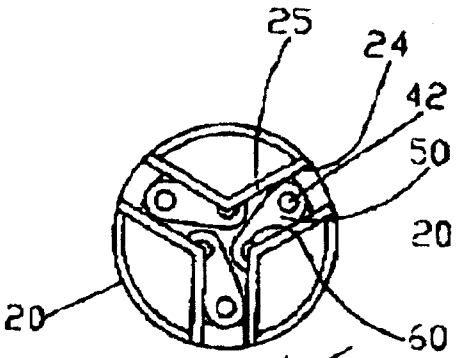
FIG. 10 is a sketch map of the connecting rod after rotation clockwise.
Figure 9:
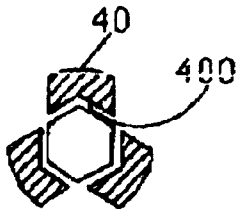
FIG. 9 is a sketch map of the pawl.
Figure 11:
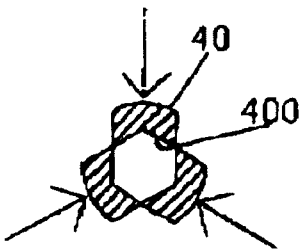
FIG. 11 is a sketch map of the pawl in another position.
Figure 12:
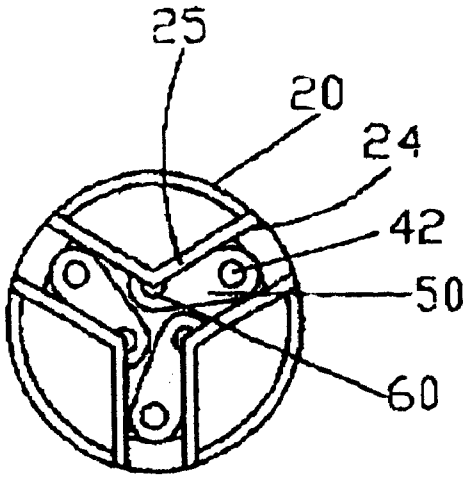
FIG. 12 is a sketch map of the connecting rod after rotation anti-clockwise.
Figure 13:
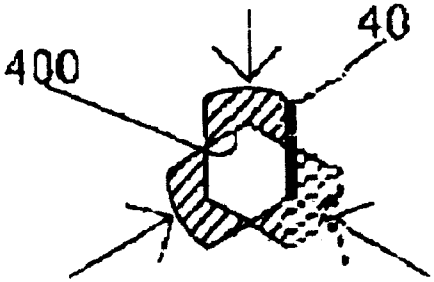
FIG. 13 is a sketch map of the pawl in the position shown in FIG. 12.

As shown in FIG. 8 and FIG. 9, when the pin 60 is at the center of the notch 24 of the sleeve body (20), the pawls (40) are at their farthermost positions. At this position, the bolt to be screwed down/up can be placed among the three pawls (40) (see also FIG. 10 and FIG. 11). If the operator turns the sleeve head 10 clockwise, the pins (60) will rotate clockwise to draw back the shaft (42) of each pawl (30), and to force the clamping surfaces (400) of the three pawls (40) to clamp the bolt together. Along with the clockwise movement of the sleeve head 10 under the drive of a wrench or ratchet wrench, the clamping surfaces (400) will clamp the bolt more and more firmly.

Similarly, if the operator wants to screw up the bolt, he/she only needs to turn the sleeve head 10 anti-clockwise to draw back the pin 60 to the center of the notch 24 of the sleeve body 20 to open the pawls (40) first, and then turn the sleeve head 10 anti-clockwise continuously to draw back the pins 60, which will make the clamping surfaces (400) of the pawls (40) to clamp the bolt. Along with the anti-clockwise movement of the sleeve head 10 under the drive of a wrench or ratchet wrench, the clamping surfaces (400) will clamp the bolt more and more firmly.

Please note that only two sets of pawls (40), connecting rods (50), and pins (60) of this invention are necessary to make the invention work normally. That is to say, three or more sets of them are not prerequisite. Furthermore, the clamping surfaces (400) can be devised on the outer wall of the pawls (40) to work with female tetragonal bolts or female hexagonal bolts. He effective journey of this invention is independent to its components except for the pins (60) and the connecting rods (50).

What is claimed is:

1. An adjustable sleeve barrel structure comprising:

a sleeve body including multiple slide rails distributed therein evenly, a sleeve head rotatably received in said sleeve body, and including a sleeve eye provided on top thereof, a plurality of pawls slidably received in said slide rails of said sleeve body respectively, said pawls each including a shaft provided on top thereof, a plurality of connecting rods connected to said shafts respectively, and a plurality of pins connecting said connecting rods to said sleeve head, said sleeve head forcing said connecting rods to force said pawls to open/close simultaneously when said sleeve head rotates.

2. The adjustable sleeve barrel structure of claim 1, in which the sleeve head includes a first end having a bearing provided thereon, to form a shoulder in the sleeve head; the sleeve body is a cylinder structure with a blind hole (1) on one end, on which there is a deeper and larger hole (2), through which the bearing (12) can be plugged and positioned at the shoulder between the blind hole (1) and the blind hole (2) of the sleeve body; on the blind hole (2) of the sleeve body there is a groove formed therein, and a snap ring engaged into the groove of the sleeve body to position the bearing of the sleeve head in the sleeve body and to allow the sleeve head and the sleeve body to rotate freely relative to each other.

3. The adjustable sleeve barrel structure of claim 1, in which the sleeve body includes a bottom having a notch running through the blind hole (1) thereof, and having said slide rails formed therein, and said slide rails each includes a gap groove formed in bottom thereof, each of the pawls has a ramped camping surface in its inner sidewall and a guided groove provided on top, the guided grooves of the pawls are coupled with the slide rails respectively.

4. The adjustable sleeve barrel structure of claim 1, in which the connecting rods each includes a first end having an eye formed therein to receive the shaft of the pawl respectively, and a second end having an eye formed therein to receive the pin respectively.

5. The adjustable sleeve barrel structure of claim 1, in which each pawl has a ramped clamping surface in its inner sidewall.

* * * * *